US010273822B2

(12) United States Patent
Strock et al.

(10) Patent No.: US 10,273,822 B2
(45) Date of Patent: Apr. 30, 2019

(54) ALUMINUM ALLOY COATING WITH RARE EARTH AND TRANSITION METAL CORROSION INHIBITORS

(71) Applicant: United Technologies Corporation, Hartford, CT (US)

(72) Inventors: Christopher W. Strock, Kennebunk, ME (US); Mark R. Jaworowski, Glastonbury, CT (US); Frank W. Mase, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 334 days.

(21) Appl. No.: 15/026,482

(22) PCT Filed: Sep. 25, 2014

(86) PCT No.: PCT/US2014/057363

§ 371 (c)(1),
(2) Date: Mar. 31, 2016

(87) PCT Pub. No.: WO2015/053948

PCT Pub. Date: Apr. 16, 2015

(65) Prior Publication Data

US 2016/0251975 A1 Sep. 1, 2016

Related U.S. Application Data

(60) Provisional application No. 61/888,802, filed on Oct. 9, 2013.

(51) Int. Cl.
*F01D 5/12* (2006.01)
*F01D 9/02* (2006.01)
(Continued)

(52) U.S. Cl.
CPC ..... *F01D 11/122* (2013.01); *C22C 21/02* (2013.01); *C23C 4/04* (2013.01); *C23C 4/06* (2013.01);
(Continued)

(58) Field of Classification Search
CPC . F01D 5/12; F01D 9/02; F01D 11/122; F01D 25/24; C22C 21/02; C23C 4/06;
(Continued)

(56) References Cited

U.S. PATENT DOCUMENTS 3,147,087 A 9/1964 Eisenlohr
3,817,719 A 6/1974 Schilke et al.
(Continued)

FOREIGN PATENT DOCUMENTS

WO 200144533 A1 6/2011
WO 2014055299 A1 4/2014

OTHER PUBLICATIONS

International Preliminary Report on Patentability dated Apr. 12, 2016, for corresponding PCT Application No. PCT/US2014/057363.

(Continued)

*Primary Examiner* — Igor Kershteyn
(74) *Attorney, Agent, or Firm* — Kinney & Lange, P.A.

(57) ABSTRACT

A corrosion resistant aluminum alloy abradable coating for use as a seal material consists of a porous base metal alloy layer containing corrosion inhibiting metal compounds dispersed throughout the porous base metal alloy layer. A method of forming a corrosion resistant aluminum alloy abradable coating consists of co-thermal spraying aluminum alloy powder plus polymer powder and particles containing corrosion inhibiting metal compounds.

17 Claims, 4 Drawing Sheets

(51) Int. Cl.

| | |
|---|---|
| ***F01D 25/24*** | (2006.01) |
| ***F01D 11/12*** | (2006.01) |
| ***C23C 4/06*** | (2016.01) |
| ***C23C 4/18*** | (2006.01) |
| ***C23C 4/129*** | (2016.01) |
| ***C23C 4/134*** | (2016.01) |
| ***C22C 21/02*** | (2006.01) |
| ***C23C 4/04*** | (2006.01) |
| ***C23C 22/02*** | (2006.01) |
| ***C23C 24/04*** | (2006.01) |
| ***C23C 26/00*** | (2006.01) |

(52) U.S. Cl.
CPC ..... *C23C 4/129* (2016.01); *C23C 4/134* (2016.01); *C23C 4/18* (2013.01); *C23C 22/02* (2013.01); *C23C 24/04* (2013.01); *C23C 26/00* (2013.01); *F01D 5/12* (2013.01); *F01D 9/02* (2013.01); *F01D 25/24* (2013.01); *F05D 2220/32* (2013.01); *F05D 2230/31* (2013.01); *F05D 2300/173* (2013.01); *F05D 2300/43* (2013.01)

(58) Field of Classification Search
CPC .. C23C 4/18; C23C 4/129; C23C 4/04; C23C 4/134; C23C 22/02; C23C 24/04; C23C 26/00; F05D 2220/32; F05D 2230/31; F05D 2300/173; F05D 2300/43
See application file for complete search history.

(56) References Cited

U.S. PATENT DOCUMENTS 4,251,272 A * 2/1981 Sara ..... B22F 3/11 415/174.4
5,185,217 A * 2/1993 Miyamoto ..... F01D 11/122 277/411
5,192,374 A 3/1993 Kindler
5,536,022 A * 7/1996 Sileo ..... C23C 4/02 277/415
6,219,482 B1 4/2001 Matsuzaki et al.
6,410,159 B1 * 6/2002 Hermanek ..... B22F 1/025 415/173.4
2005/0260434 A1 * 11/2005 Nelson ..... C23C 4/18 428/632
2006/0028095 A1 12/2006 Spitsberg et al.
2010/0129636 A1 * 5/2010 Cybulsky ..... C04B 41/009 428/310.5
2011/0015917 A1 6/2011 Groh et al.
2014/0199163 A1 * 7/2014 Lee ..... C23C 28/04 415/174.4

OTHER PUBLICATIONS

International Search Report and Written Opinion dated Jan. 16, 2015, for corresponding PCT Application No. PCT/US2014/057363.
Kamal, Subhash, "Mechanical and Microstructural characteristics of detonation gun sprayed NiCrAlY + .4 wt% CeO2 coatings on superalloys", Materials Chemistry and Physics, dated 2010, 7 pages.
Sun, Xiaoguang, "Mechanical Properties and Thermal Shock Resistance of HVOF Sprayed NiCrAlY Coatings Without and With Nano Ceria", Journal of Thermal Spray Technology, dated Sep. 2012, 7 pages.
Partial Supplementary European Search Report, for European Patent Application No. 14852182.6, dated May 30, 2017, 14 pages.
Supplemental Extended European Search Report, for European Patent Application No. 14852182.6, dated Sep. 28, 2017, 10 pages.

* cited by examiner

ALUMINUM ALLOY COATING WITH RARE EARTH AND TRANSITION METAL CORROSION INHIBITORS

BACKGROUND

Gas turbine engines include fans and compressor rotors having a plurality of rotating blades. Minimizing the leakage of air, such as between tips of rotating blades and a casing of a gas turbine engine, increases the efficiency of the gas turbine engine because the leakage of air over the tips of the blades can cause aerodynamic efficiency losses. To minimize this, gaps at tips of the blade are set small and, under certain conditions, the blade tips may rub against and engage an abradable seal at the casing of the gas turbine engine. The abradability of the seal material prevents damage to the blades while the seal material itself wears to generate an optimized mating surface and thus reduce the leakage of air.

Aluminum based abradable coatings that are used in fan and compressor blade outer seal applications are prone to aqueous corrosion. The coatings are porous and absorb water that subsequently dries during use. When this process is repeated, contaminants in the water concentrate and can produce a conductive and corrosive electrolyte, while water is present. The conductive water trapped within the porosity of the coating results in an increased tendency for internal corrosion or crevice corrosion. The result is that the coating becomes weaker, has reduced ductility, loses its abradable characteristics, and can spall and damage airfoils.

SUMMARY

A corrosion resistant aluminum alloy abradable coating for use as a seal material consists of a thermally sprayed porous base metal alloy layer containing corrosion inhibiting metal compounds dispersed throughout the porous base metal alloy layer.

In an embodiment, a method of forming a corrosion resistant aluminum alloy abradable coating includes thermal spraying first base metal alloy particles and fugitive polymer particles on a structure to form a porous base metal alloy layer. Particles containing corrosion inhibiting metal compounds are sprayed on the structure at the same time to disperse the metal compounds throughout the porous base metal coating.

DETAILED DESCRIPTION

Figure 1:
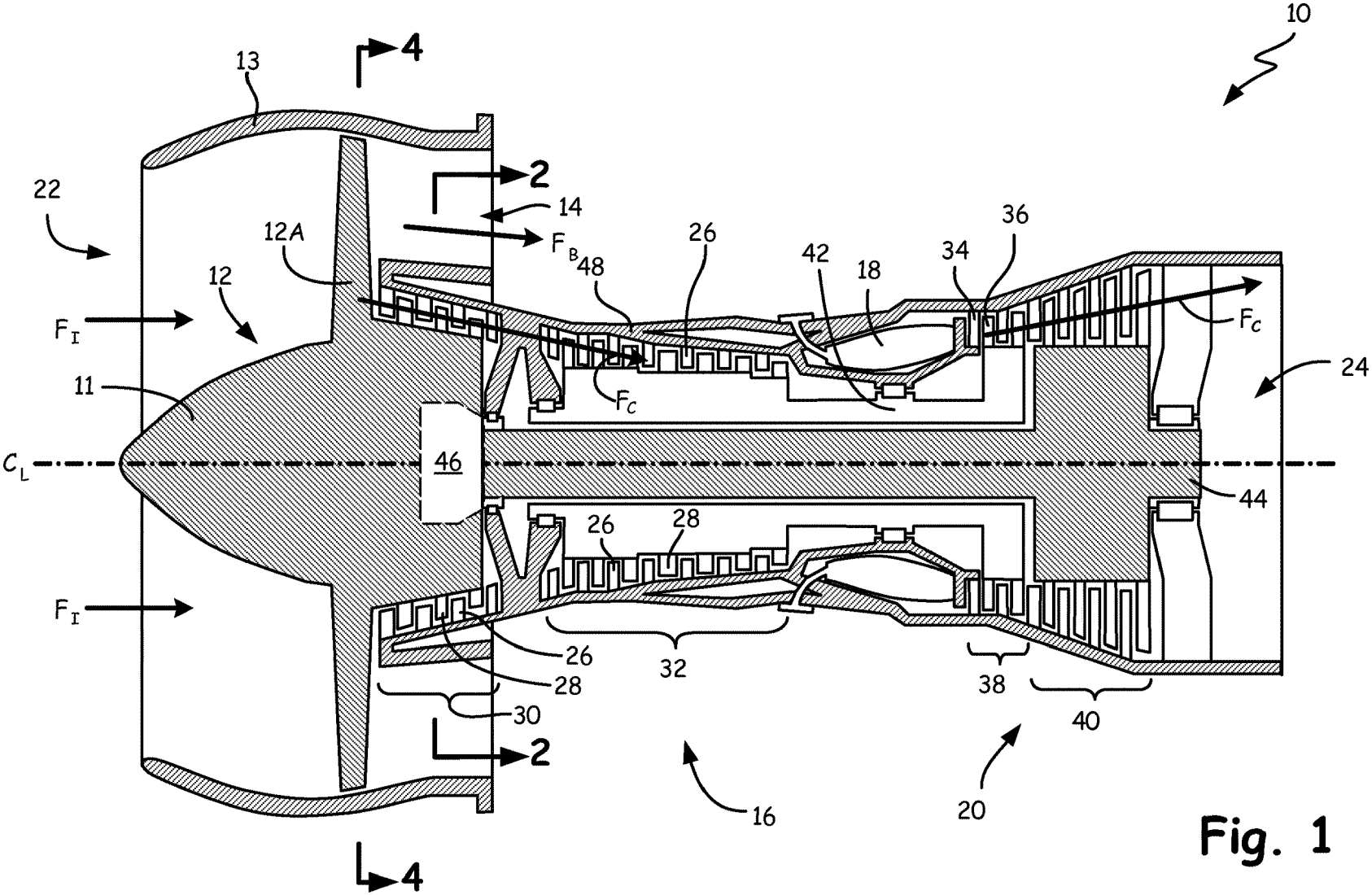
FIG. 1 is a simplified cross-sectional view of a gas turbine engine.

FIG. 1 is a cross sectional view of gas turbine engine 10 in a turbo fan environment. As shown in FIG. 1, turbine engine 10 comprises fan 12 positioned in bypass duct 14, with bypass duct 14 oriented about a turbine core comprising compressor section 16, combustor (or combustors) 18, and turbine section 20, arranged in flow series with upstream inlet 22 and downstream exhaust stream 24.

Compressor 16 comprises stages of compressor vanes 26 and blades 28 arranged in low pressure compressor (LPC) section 30 and high pressure compressor (HPC) section 32. Turbine 20 comprises stages of turbine vanes 34 and turbine blades 36 arranged in high pressure turbine (HPT) section 38 and low pressure turbine (LPT) section 40. HPT Section 38 is coupled to HPC section 32 via HPT shaft 42, forming the high pressure spool or high spool. LPT section 40 is coupled to LPC Section 30 and fan 12 via LPT shaft 44, forming the low pressure spool or low spool. HPT shaft 42 and LPT shaft 44 are typically coaxially mounted, with the high and low spools independently rotating about turbine axis ($C_L$.).

Fan 12 comprises a number of fan airfoils 12A circumferentially arranged around a fan hub 11 or other rotating member in fan shroud 13. Fan hub 11 is coupled directly or indirectly to LPC section 30 and driven by LPT shaft 44. In some embodiments, fan hub 11 is coupled to the fan spool via geared fan drive mechanism 46, providing independent fan speed control.

As shown in FIG. 1, fan 12 is forward mounted and provides thrust by accelerating flow downstream through bypass duct 14, for example, in a high bypass configuration suitable for commercial and regional jet aircraft operations. Alternatively, fan 12 may be an unducted fan or propeller assembly, in either a forward or aft mounted configuration. In these various embodiments, turbine engine 10 comprises any of a high bypass turbofan, a low bypass turbofan or a turbo prop engine, in which the number of spools and shaft configurations may vary. In operation of turbine engine 10, incoming airflow $F_I$ enters inlet 22 and divides into core flow $F_C$ and bypass flow $F_B$ downstream of fan hub 11. Core flow $F_C$ propagates along the core flow path through compressor section 16, combustor 18, and turbine section 20 and bypass flow $F_B$ propagates along the bypass flowpath through bypass duct 14. LPC section 30 and HPC section 32 of compressor 16 are utilized to compress incoming air for combustor 18 where fuel is introduced, mixed with air and ignited to produce hot combustion gas. Depending on embodiment, fan hub 11 also provides some degree of compression (or pre-compression) to core flow $F_C$ and LPC section 30 (or a portion of it) may be omitted. Alternatively, an additional intermediate spool may be included, for example, in a three spool turboprop or turbofan configuration.

Combustion gas exits combustor 18 and enters HPT (section 38) of turbine 20, encountering turbine vanes 34 and turbine blades 36. Turbine vanes 34 turn and accelerate the flow, and turbine blades 36 generate lift for conversion to rotational energy via HPT shaft 42, driving HPC section 32 of compressor 16 via HPT shaft 42. Partially expanded combustion gas transitions from HPT section 38 to LPT 40, driving LPC section 30 and fan 11 via LPT shaft 44. Exhaust flow exits LPT section 40 and turbine engine 10 via exhaust nozzle 24.

The thermodynamic efficiency of turbine engine 10 is tied to the overall pressure ratio as defined between the delivery pressure at inlet 22 and the compressed air pressure entering combustor 18 from compressor section 16. In general, a higher pressure ratio offers increased efficiency and improved performance including greater specific thrust. High pressure ratios also result in increased peak gas path temperatures, higher core pressure, and greater flow rates, increasing thermal and mechanical stress on engine components.

The present invention may be used with airfoils and turbine engines. The term "airfoil" includes fan blades, rotor blades, and stator blades. This invention can be used to produce corrosion resistant abradable aluminum alloy seals in the lower temperature sections of engine 10 that are subject to atmospheric corrosion. Corrosion resistance is achieved by the incorporation of rare earth or transition metal compounds in the porous abradable seal structure. In an embodiment, $Ce^{3+, 4+}$, $Co^{2+, 3+}$, $Mo^{6+}$, $W^{6+}$ and $V^{5+}$ compounds are included as corrosion inhibitors in a porous abradable aluminum seal structure of the invention. The corrosion inhibiting effect of $Ce^{3+}$ ions on 3003 aluminum alloy is reported in Liu et al. J Appl Electrochem (2011) 41:383-388, wherein $Ce^{3+}$ was found to act as a cathodic inhibitor reducing the corrosion of aluminum 3003 alloy in flowing ethylene glycol-water solutions. Thermal sprayed aluminum alloy seals are used in the lower temperature region of engine 10 that is subject to atmosphere exposure and corrosion such as fan 12 and LPC section 30. It is the purpose of this invention to provide porous aluminum alloy abradable seals with resistance to atmospheric corrosion, particularly aqueous corrosion in this region of engine 10. It will become apparent from the forthcoming disclosure that the incorporation of certain rare earth and transition metal compounds to the porous aluminum alloy abradable seal results in the required corrosion resistance and resulting increased component lifetime.

Figure 2:
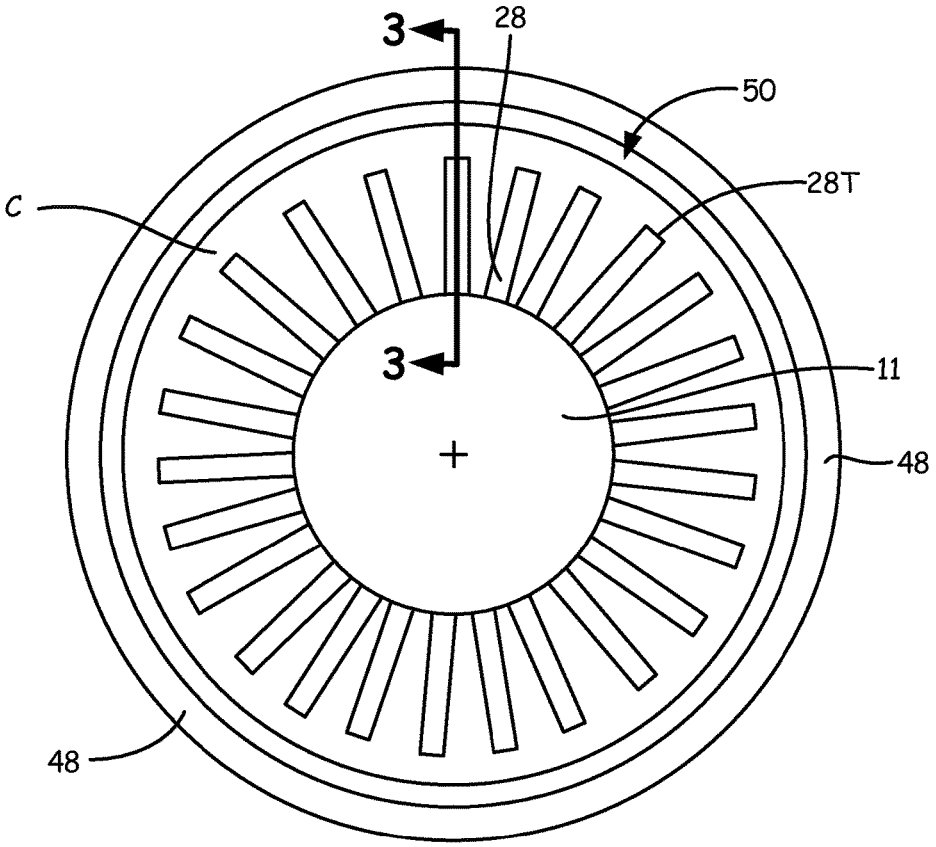
FIG. 2 is a cross-sectional view illustrating the relationship of a casing or shroud and blades taken along the line 2-2 of FIG. 1, not to scale.
Figure 3A:
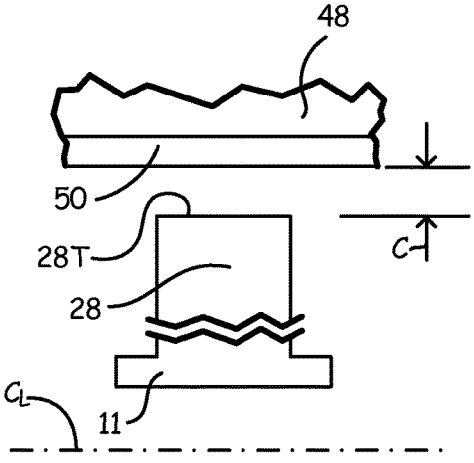
FIG. 3A is a cross-sectional view taken along the line 3-3 of FIG. 2, of a casing or shroud and blade not to scale.
Figure 3B:
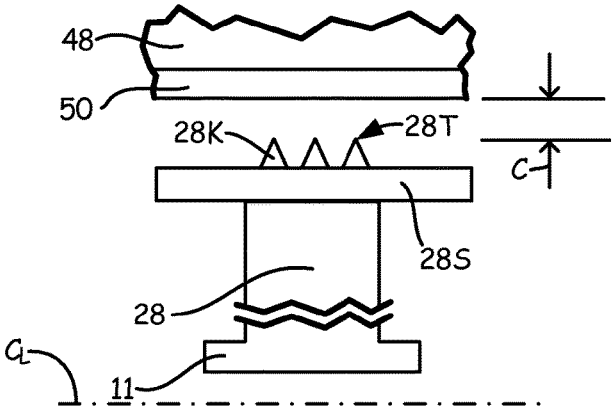
FIG. 3B is a cross-sectional view taken along the line 3-3 of FIG. 2 of a casing or shroud and blade with a knife edge seal, not to scale.
Figure 4:
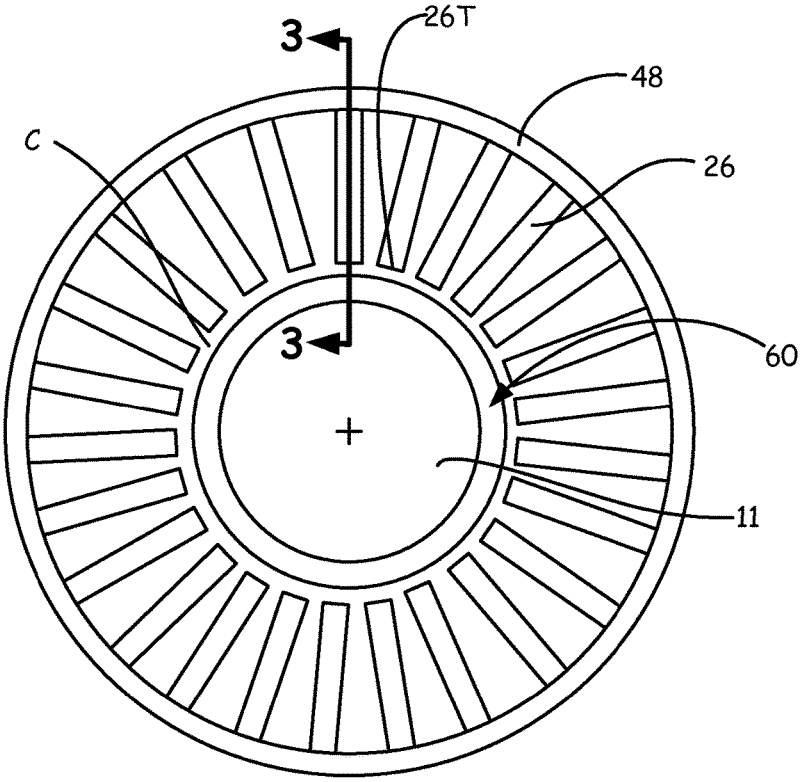
FIG. 4 is a cross-sectional view illustrating the relationship between a fan hub rotor and vanes taken along the line 2-2 of FIG. 1, not to scale.
Figure 5A:
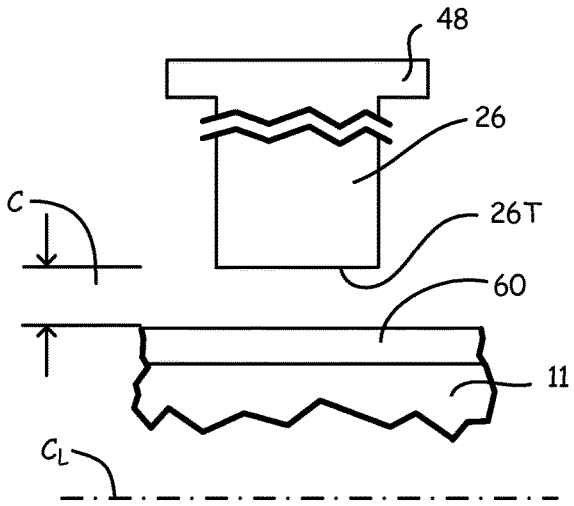
FIG. 5A is a cross-sectional view taken along the line 5-5 of FIG. 4, of a fan hub rotor and vane, not to scale.
Figure 5B:
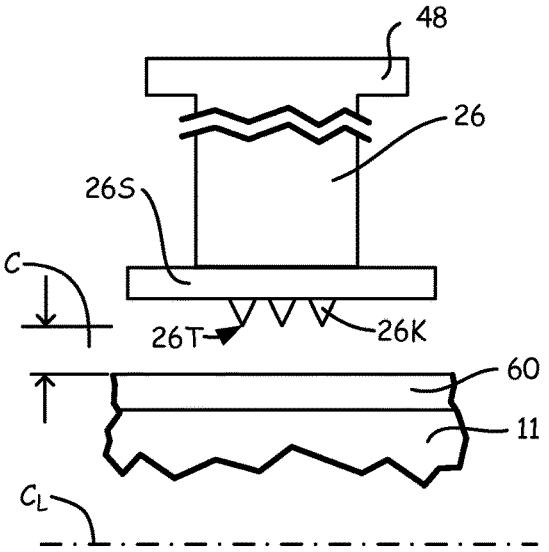
FIG. 5B is a cross-sectional view taken along the line 5-5 of FIG. 4 of a fan hub rotor and vane with a knife seal, not to scale.
Figure 6:
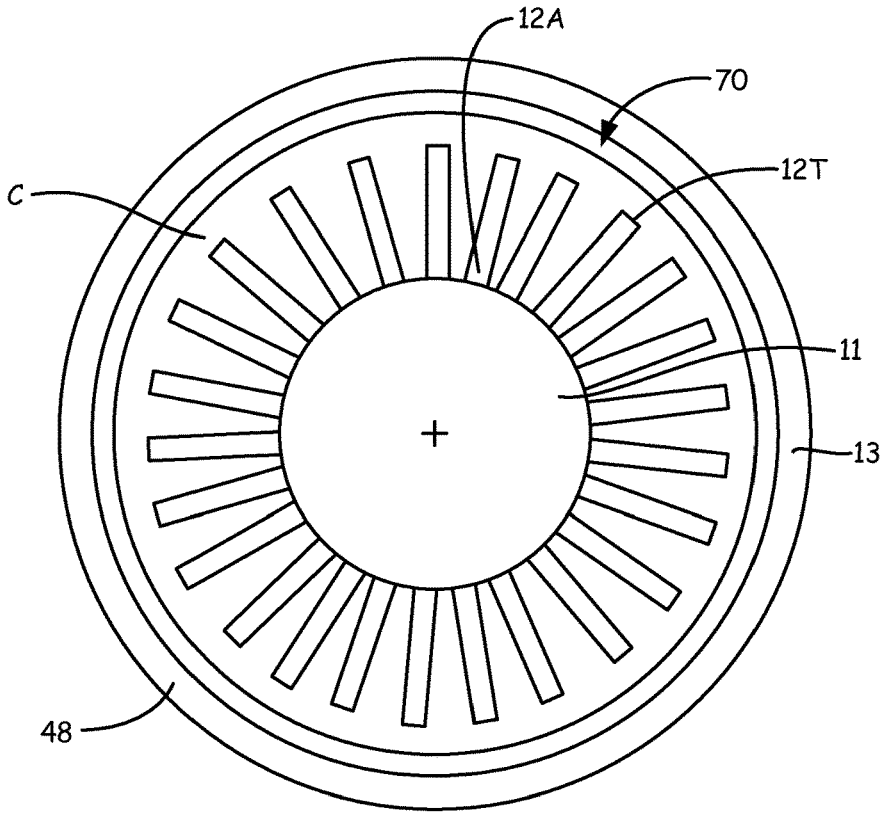
FIG. 6 is a cross-sectional view illustrating the relationship between a fan shroud and fan blades taken along the line 4-4 of FIG. 1, not to scale.

FIGS. 2, 3A and 3B disclose an application of the invention with respect to interaction of a rotor blade or fan blade with a stator casing or shroud. FIGS. 4, 5A and 5B disclose an application of the invention with respect to interaction of a stator vane with a rotor hub. FIG. 6 discloses an application of the invention with respect to the interaction of a fan blade and fan shroud. The coating of this invention may be used with these configurations and others known in the art.

FIG. 2 is a cross-section along line 2-2 in FIG. 1 which has a rotor shaft (fan hub 11) inside casing 48. Rotor blades 28 are attached to fan hub 11 and the clearance between blades 28 and casing 48 is indicated by C. Abradable coating 50 of the invention is on casing 48 such that the clearance between blade tips 28T of blades 28 and coating 50 has the proper tolerance for operation of the engine, e.g. to serve as a seal to prevent leakage of air (thus increasing efficiency), while not interfering with the relative movement of the blades and the casing 48. In FIG. 2 and FIGS. 3A and 3B, clearance C is expanded for purpose of illustration. In practice, clearance C may be between 762 microns (30 mils) and 3810 microns (150 mils) when the engine is cold and 0.000 to 2032 microns (80 mils) during operation depending on the specific operating condition and previous rub events that may have occurred. FIG. 3A shows the cross-section along line 3-3 of FIG. 2 with casing 48 and blade 28. FIG. 3A shows porous corrosion resistant aluminum alloy abradable coating 50 of the invention on casing 48. Abradable coating 50 is directly deposited on casing 48 by thermal spray. FIG. 3B shows the cross-section along line 3-3 of FIG. 2 wherein blade 28 is tipped with shroud 28S and knife edge seals 28K.

FIGS. 4, 5A and 5B disclose the invention with respect to interaction of a stator vane with a rotor hub. FIG. 4 is a cross-section along line 2-2 of FIG. 1 of casing 48 which has a rotor shaft, in this case fan hub 11, inside. Vanes 26 are attached to casing 48. Coating 60 is on fab hub 11 such that the clearance C between coating 60 and vane tips 26T of vanes 26 has the proper tolerance for operation of the engine, e.g. to serve as a seal to prevent leakage of air (thus reducing efficiency) while not interfering with the relative movement of vanes 26 and fan hub 11. In FIGS. 4, 5A and 5B, clearance C is expanded for purposes of illustration. In practice, clearance C may be, for example, in a range of about 508 microns (20 mils) to about 1270 microns (50 mils) when the engine is cold and 0.000 microns to 762 microns (30 mils) during operation depending on the specific operating condition and previous rub events that may have occurred. FIG. 5A shows the cross-section along line 3-3 of FIG. 4 with casing 48 and vane 26. FIG. 5A shows porous corrosion resistant aluminum alloy abradable coating 60 of the invention on fan hub 11. Abradable coating 60 is directly deposited on fan hub 11 by thermal spray. FIG. 5B shows the cross-section along line 3-3 of FIG. 4 with casing 48 and vane 26 wherein vane 26 is tipped with shroud 26S and knife edge seals 26K.

FIG. 6 is a cross-section along line 4-4 in FIG. 1 which has a rotor shaft, fan hub 11, inside fan shroud 13. Fan blades 12A are attached to fan hub 11 and the clearance between fan blades 12A and fan shroud 13 is indicated by C. Abradable coating 70 of the invention is on fan shroud 13 such that the clearance between blade tips 12T of fan blades 12 and coating 70 has the proper tolerance for operation of the engine, e.g. to serve as a seal to prevent leakage of air (thus reducing efficiency) while not interfering with relative movements of the blades in shroud 13. Similar consideration of clearance between fan blades 12 and fan shroud 13 as discussed in FIGS. 2-5B are relevant here.

In an embodiment, corrosion resistant abradable coating of the invention is applied to all sealing surfaces discussed. In particular, coating 50 on casing 48, coating 60 on fan hub 11 and coating 70 on fan shroud 13.

The corrosion resistant abradable seal material of the invention is a lightweight, porous aluminum alloy. Preferably, the seal material is an aluminum silicon alloy. More preferably, the seal material is an aluminum silicon alloy containing about 12 weight percent silicon and the remainder substantially aluminum. The alloy is formed by thermal spray wherein thermal spray may comprise one of flame spray, plasma spray, high velocity oxy fuel (HVOF), or cold spray.

Porosity is introduced into the alloy typically by co-deposition of metal seal particles and particles of a fugitive material such as polymethyl methacrylate (Lucite) or polyester. Heat treatment following deposition decomposes the fugitive material and the reaction products escape through interconnected porosity to form a porous metal coating suitable for an abradable seal material of the invention.

Coatings on regions that are exposed to atmospheric degradation from aqueous, chloride and other chemical exposure require corrosion protection. As noted above, in aluminum alloys, this protection can be accomplished by incorporating certain rare earth or transition metal compounds throughout the coating in particulate or chemical form.

Figure 7:
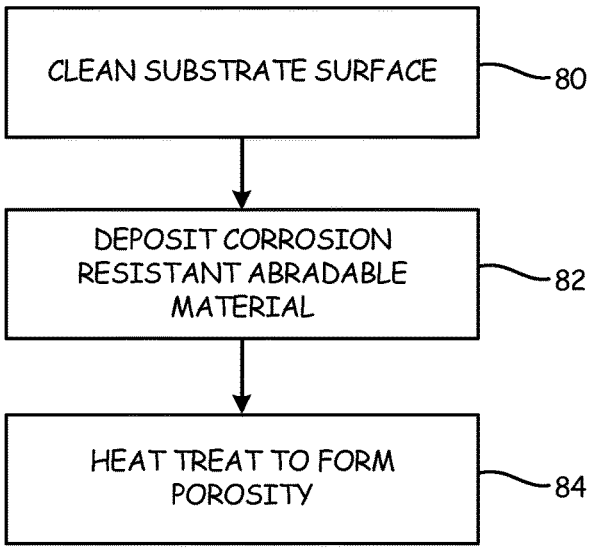
FIG. 7 is a method to produce an abradable seal containing corrosion inhibiting metal compounds.

A method of forming a corrosion resistant porous aluminum alloy abradable coating of the instant invention is shown in FIG. 7. The first step in the process is to clean and otherwise prepare the substrate surface. (Step 80). Conventional cleaning and preparation is by methods known to those in the art of thermal and high velocity coating deposition. Processes such as mechanical abrasion through vapor or air blast processes using dry or liquid carried abrasive particles impacting the surface are standard.

The next step is to deposit the corrosion resistant abradable seal material of the invention. (Step 82). There are two main aspects to this process. The first aspect is the deposition of the porous aluminum alloy base seal material itself. This process may be carried out by the co-deposition of particles of the aluminum silicon alloy of the invention and fugitive polymer particles. A method of accomplishing this is, for example, to introduce the metal particles and polymer particles into the thermal flame or plume at the same time during deposition. The position of entrance into the flame depends on the thermal properties of the material. Due to their lower melting points, polymers may be introduced in lower temperature downstream portions of the flame. Metal particles used in this process may have sizes from about 11 microns (0.43 mils) to about 125 microns (4.92 mils) and fugitive polymer particles may have sizes from about 25 microns (0.98 mils) to about 150 microns (5.9 mils).

As mentioned, preferred rare earth and transition metal compounds imparting corrosion resistance to the base aluminum silicon alloy of the invention are $Ce^{3+}$, $Ce^{4+}$, $Co^{2+}$, $Co^{3+}$, $Mo^{6+}$, $W^{6+}$, and $V^{5+}$ compounds and their mixtures. These compounds can be introduced to the porous aluminum silicon alloy abradable seal material of the invention during deposition in a number of ways. They can be introduced in a number of forms such as solid metal alloy, solid metal oxide, solid metal salt, liquid aqueous solution, liquid or solid polymer solution and others. They may also be introduced to the coating from a single thermal spray source or from one or more multiple spray sources during deposition. They may be deposited at different times but preferably deposition of each material during formation of the abradable seal is concurrent.

Thermal spray feed stock for the coatings of the invention may be aluminum alloy particles, fugitive polymer particles, and Ce, Co, Mo, W, or V containing additions.

The Ce, Co, or Mo additions may be oxide or hydroxide powders of $Ce^{3+}$, $Ce^{4+}$, $Co^{2+}$, $Co^{3+}$, $Mo^{6+}$, $W^{6+}$, or $V^{5+}$. Examples include $Ce^{4+}O_2$, $Ce^{3+}(OH)_3$, $Mo^{6+}O_3$, $Co^{2+}O$, $Co_2{}^{3+}O_3$, $W^{6+}O_3$, or $V^{5+}{}_2O_5$ The Ce, Co, Mo, W, or V additions may be in the form of elemental, alloy, or other inhibitor compound powders. The powder sizes may be between 0.1 microns (0.004 mils) and 10 microns (0.39 mils) The Ce, Co, Mo, W, or V additions may be in the form of coatings or cladding on aluminum alloy particles. The Ce, Co, Mo, W, or V additions may be mixed with aluminum alloy particles and fugitive polymer powder and an organic binder such as PVA and spray dried to form a composite spherical powder thermal spray feed stock.

The Ce, Co, Mo, W or V additions may also be in the form of sol gel powders. The sol gel powder size may be between 10 nm (0.0004 mils) and 400 nm (0.061 mils).

The Ce, Co, Mo, W, or V additions may be in the form of organic or inorganic salts. An example is cerium citrate.

The Ce, Co, Mo, W, or V additions may be added to the porous aluminum alloy seal material as an infiltrant in liquid solution form or as an infiltrant in solid particle suspension in a liquid solution following the deposition of the porous aluminum alloy seal. The particles in liquid suspension may have particle sizes between 0.1 microns (0.004 mils) and 10 microns (0.39 mils).

Discussion of Possible Embodiments

The following are non-exclusive descriptions of possible embodiments of the present invention.

A corrosion resistant abradable aluminum alloy coating on a turbo machine structure may include: at least one porous base metal alloy layer; and corrosion inhibiting compounds dispersed throughout the porous base metal layer.

The alloy coating of the preceding paragraph can optionally include, additionally and/or alternatively any, one or more of the following features, configurations and/or additional components:

The porous base metal alloy layer may be formed by thermal spray.

The corrosion inhibiting metal compounds may include Ce, Co, Mo, W, or V metal compounds and mixtures thereof.

The Ce, Co, Mo, W, or V metal compounds and mixtures thereof may be in the form of organic and inorganic salts.

The corrosion inhibiting metal compounds may include $Ce^{3+}$, $Ce^{4+}$, $Co^{2+}$, $Co^{3+}$, $Mo^{6+}$, $W^{6+}$, or $V^{5+}$ metal compounds and mixtures thereof.

The corrosion inhibiting metal compounds may include $Ce^{4+}O_2$, $Ce^{3+}(OH)_3$, $Mo^{6+}O_3$, $Co^{2+}O$, $Co_2{}^{3+}O_3$, $W^{6+}O_3$, or $V_2O_5$ metal compounds and mixtures thereof.

The porous aluminum alloy base metal layer may be an aluminum silicon alloy.

The aluminum silicon alloy may be about 12 weight percent silicon and the remainder substantially aluminum.

The corrosion inhibiting metal compounds may be added to the porous base metal coating as an infiltrant in solid particle suspension liquid solution form in a carrier liquid following the deposition of the porous base metal alloy coating.

A method of forming a corrosion resistant coating on a turbo machine structure may include: thermal spraying base metal aluminum alloy particles and fugitive polymer particles to form a porous base metal alloy layer; and co-spraying a second feed stock containing corrosion inhibiting metal compounds to disperse the corrosion inhibiting metal compounds throughout the porous base metal coating.

The method of the preceding paragraph can optionally include, additionally and/or alternatively any, one or more of the following features, configurations and/or additional components:

The base metal alloy may include an aluminum silicon alloy containing about 12 weight percent silicon and the remainder substantially aluminum.

The fugitive polymer particles may be polymethyl methacrylate or polyester.

The corrosion inhibiting metal compounds may include $Ce^{3+}$, $Ce^{4+}$, $Co^{2+}$, $Co^{3+}$, $Mo^{6+}$, $W^{6+}$, or $V^{5+}$ metal compounds and mixtures thereof.

The second feed stock containing corrosion inhibiting metal compounds may include metal powder, metal oxide powder, metal salts, metal sol gel precursor powder, aqueous solutions of metal compounds, polymer solutions of metal compounds, composite polymer/metal powder, and composite polymer/oxide powder.

The thermal spraying may include thermal spraying, plasma spraying, high velocity oxy fuel (HVOF), and cold spraying.

The corrosion inhibiting metal compounds may be added to the porous base metal coating as an infiltrant in liquid solution form following deposition of the porous base metal alloy coating.

A seal for a gas turbine engine may include a porous corrosion resistant abradable coating on a surface in rotating proximity to a metal airfoil or housing wherein forming the abradable coating may include: thermal spraying first base metal aluminum alloy particles and fugitive polymer particles on the surface; co-thermal spraying particles containing corrosion inhibiting metal compounds on the surface to disperse the metal compounds throughout the porous base metal coating.

The seal of the preceding paragraph can optionally include, additionally and/or alternatively any, one or more of the following features, configurations and/or additional components:

The base metal aluminum alloy particles may be an aluminum silicon alloy.

The corrosion inhibiting metal compounds may be $Ce^{3+}$, $Ce^{4+}$, $Co^{2+}$, $Co^{3+}$, $Mo^{6+}$, $W^{6+}$, or $V^{5+}$ metal compounds and mixtures thereof.

The particles containing corrosion inhibiting metal compounds may include metal powder, metal oxide powder, metal salts, metal sol gel precursor powder, aqueous solutions of metal compounds, polymer solutions of metal compounds, composite polymer/metal powder, and composite polymer/oxide powder.

Although the present invention has been described with reference to preferred embodiments, workers skilled in the art will recognize that changes may be made in form and detail without departing from the spirit and scope of the invention.

The invention claimed is:

1. A corrosion resistant abradable aluminum alloy coating on a turbo machine structure comprising:

at least one porous base metal alloy layer; and corrosion inhibiting compounds dispersed throughout the porous base metal layer;

wherein the corrosion inhibiting metal compounds comprise $Mo^{6+}$, $W^{6+}$ or $V^{5+}$ metal compounds and mixtures thereof.

2. The coating of claim 1 wherein the porous base metal alloy layer is formed by thermal spray.

3. The coating of claim 1 wherein the $Mo^{6+}$, $W^{6+}$, or $V^{5+}$ metal compounds and mixtures thereof are in the form of organic and inorganic salts.

4. The coating of claim 1 wherein the $Mo^{6+}$, $W^{6+}$, or $V^{5+}$ metal compounds and mixtures thereof comprise $Mo^{6+}O_3$, $W^{6+}O_3$, or $V^{5+}{}_2O_5$ metal compounds and mixtures thereof.

5. The coating of claim 1 wherein the porous aluminum alloy base metal layer comprises an aluminum silicon alloy.

6. The coating of claim 5 wherein the aluminum silicon alloy comprises about 12 weight percent silicon and the remainder substantially aluminum.

7. The coating of claim 1 wherein the corrosion inhibiting metal compounds are added to the porous base metal alloy layer as an infiltrant in liquid solution form following the deposition of the porous base metal alloy coating.

8. The coating of claim 1 wherein the corrosion inhibiting metal compounds are added to the porous base metal alloy layer as an infiltrant in solid particle suspension form in a carrier liquid.

9. A method of forming a corrosion resistant coating on a turbo machine structure comprising:

thermal spraying a first feed stock comprising base metal aluminum alloy particles and fugitive polymer particles to form a first porous base metal alloy layer; and co-spraying a second feed stock containing corrosion inhibiting metal compounds to disperse the corrosion inhibiting metal compounds throughout the porous base metal alloy layer.

10. The method of claim 9 wherein the base metal alloy comprises an aluminum silicon alloy containing about 12 weight percent silicon and the remainder substantially aluminum.

11. The method of claim 9 wherein the fugitive polymer particles comprise polymethyl methacrylate or polyester.

12. The method of claim 9 wherein the corrosion inhibiting metal compounds comprise $Ce^{3+}$, $Ce^{4+}$, $Co^{2+}$, $Co^{3+}$, $Mo^{6+}$, $W^{6+}$, or $V^{5+}$ metal compounds and mixtures thereof.

13. The method of claim 9 wherein the second feed stock containing corrosion inhibiting metal compounds comprises metal powder, metal oxide powder, metal salts, metal sol gel precursor powder, aqueous solutions of metal compounds, polymer solutions of metal compounds, composite polymer/metal powder and, composite polymer/metal oxide powder.

14. The method of claim 9 wherein thermal spraying comprises thermal spraying, plasma spraying, high velocity oxy fuel (HVOF) and cold spraying.

15. The method of claim 9 wherein the corrosion inhibiting metal compounds are added to the porous base metal alloy layer as an infiltrant in liquid solution form following deposition of the porous base metal alloy coating.

16. The method of claim 9 wherein the corrosion inhibiting metal compounds are added to the porous base metal alloy layer as an infiltrant in solid particle suspension form in a carrier liquid.

17. A seal for a gas turbine engine comprising a porous corrosion resistant abradable coating on a surface in rotating proximity to a metal airfoil or housing wherein forming the abradable coating comprises:

thermal spraying a first feed stock comprising base metal aluminum alloy particles and fugitive polymer particles on the surface to form a first porous metal aluminum alloy layer;

co-spraying a second feed stock containing corrosion inhibiting metal compounds on the surface to disperse the corrosion inhibiting metal compounds throughout the porous base metal alloy layer, wherein the corrosion inhibiting metal compounds comprise $Co^{3+}$, $Mo^{6+}$, $W^{6+}$, and $V^{5+}$ metal compounds and mixtures thereof.

* * * * *